United States Patent [19]

Chou

[11] Patent Number: 4,490,241

[45] Date of Patent: Dec. 25, 1984

[54] SECONDARY INJECTION OF ZSM-5 TYPE ZEOLITE IN CATALYTIC CRACKING

[75] Inventor: Tai-Sheng Chou, Sewell, N.J.

[73] Assignee: Mobil Oil Corporation, New York, N.Y.

[21] Appl. No.: 488,860

[22] Filed: Apr. 26, 1983

[51] Int. Cl.[3] ..... C10G 51/04

[52] U.S. Cl. ..... 208/75; 502/49; 208/120

[58] Field of Search ..... 208/120, 113, 74, 75; 502/49

[56] References Cited

U.S. PATENT DOCUMENTS

| | | | |
|---|---|---|---|
| 3,639,228 | 2/1972 | Carr et al. | 208/153 |
| 3,649,522 | 3/1972 | Martin | 208/120 |
| 3,748,251 | 7/1973 | Demmel et al. | 208/74 |
| 3,758,403 | 9/1973 | Rosinski et al. | 208/120 |
| 3,769,202 | 10/1973 | Plank et al. | 208/111 |
| 3,803,024 | 4/1974 | Haunschild | 208/76 |
| 3,894,931 | 7/1975 | Nace et al. | 208/73 |
| 3,894,933 | 7/1975 | Owen et al. | 208/77 |
| 3,894,934 | 7/1975 | Owen et al. | 208/78 |
| 3,926,778 | 12/1975 | Owen et al. | 208/74 |
| 3,928,172 | 12/1975 | Davis, Jr. et al. | 208/77 |
| 3,997,428 | 12/1976 | McKenna | 208/78 |
| 4,116,814 | 9/1978 | Zahner | 208/78 |
| 4,239,654 | 12/1980 | Gladrow et al. | 208/120 |
| 4,257,875 | 3/1981 | Lengemann et al. | 208/113 |
| 4,309,279 | 1/1982 | Chester et al. | 208/120 |
| 4,368,114 | 1/1983 | Chester et al. | 208/120 |

*Primary Examiner*—Delbert E. Gantz
*Assistant Examiner*—O. Chaudhuri
*Attorney, Agent, or Firm*—Alexander J. McKillop; Michael G. Gilman; Laurence P. Hobbes

[57] ABSTRACT

A catalytic cracking process comprising secondary injection of an additive catalyst, ZSM-5 type zeolite, at a point downstream of the point of introduction of the hydrocarbon feed is disclosed.

11 Claims, 3 Drawing Figures

SECONDARY INJECTION OF ZSM-5 TYPE ZEOLITE IN CATALYTIC CRACKING

BACKGROUND OF THE INVENTION

1. Field of the Invention

This invention relates to an improved process of increasing gasoline octane number and total yield while also increasing operational flexibility in catalytic cracking units by the addition of an additive catalyst to conventional cracking catalysts.

2. Description of the Prior Art

Hydrocarbon conversion processes utilizing crystalline zeolites have been the subject of extensive investigation during recent years, as is obvious from both the patent and scientific literature. Crystalline zeolites have been found to be particularly effective for a wide variety of hydrocarbon conversion processes, including the catalytic cracking of a gas oil to produce motor fuels and have been described and claimed in many patents, including U.S. Pat. Nos. 3,140,249; 3,140,251; 3,140,252; 3,140,253; and 3,271,418. It is also known in the prior art to incorporate the crystalline zeolite into a matrix for catalytic cracking and such disclosure appears in one or more of the above-identified U.S. patents.

It is also known that improved results are obtained with regard to the catalytic cracking of gas oils if a crystalline zeolite having a pore size of less than 7 Angstrom units is included with a crystalline zeolite having a pore size greater than 8 Angstrom units, either with or without a matrix, see, e.g., U.S. Pat. No. 3,769,202. Although the incorporation of a crystalline zeolite having a pore size of less than 7 Angstrom units into a catalyst composite comprising a larger pore size crystalline zeolite (pore size greater than 8 Angstrom units) has indeed been very effective with respect to the raising of octane number, nevertheless it did so at the expense of the overall yield of gasoline.

In order to reduce automobile exhaust emissions to meet federal and state pollution requirements, many automobile manufacturers have equipped the exhaust systems of their vehicles with catalytic converters. Said converters contain catalysts which are poisoned by tetraethyl lead. Since tetraethyl lead has been widely used to boost the octane number of gasoline, refiners now have to turn to alternate means to improve gasoline octane number.

Many methods of octane improvement, however, reduce the yield of gasoline. With the present short supply of available crude oil and the concomitant high demand for unleaded gasoline with a sufficiently high octane number, refiners are faced with a severe dilemma. These trends are likely to continue in the foreseeable future.

One method of increasing octane number is to raise the cracker reactor temperature. This method, however, is very limited, since many units are now operating at maximum temperatures due to metallurgical limitations. Increasing the cracker reactor temperature also results in increased requirements for the downstream gas plant (i.e. gas compressor and separator). Since most gas plants are now operating at maximum capacity, any increased load could not be tolerated by the present equipment.

Improved results in catalytic cracking with respect to both octane number and overall yield are claimed in the process of U.S. Pat. No. 3,758,403. In said patent, the cracking catalyst was comprised of a large pore size crystalline zeolite (pore size greater than 7 Angstrom units) in admixture with ZSM-5 type zeolite wherein the ratio of ZSM-5 type zeolite to large pore size crystalline zeolite was in the range of 1:10 to 3:1.

The use of ZSM-5 type zeolite in conjunction with a zeolite cracking catalyst of the X or Y faujasite variety is described in U.S. Pat. Nos. 3,894,931; 3,894,933; and 3,894,934. The two former patents disclose the use of ZSM-5 type zeolite in amounts up to about 5 to 10 weight percent; the latter patent discloses the weight ratio of ZSM-5 type zeolite to large pore size crystalline zeolite in the range of 1:10 to 3:1.

The processes of U.S. Pat. Nos. 4,309,279 and 4,368,114 are predicated on the criticality of using only miniscule amounts of additive catalyst comprising ZSM-5 class zeolite to achieve improved results with respect to octane number and overall yield. In those processes 0.1 to 0.5% wt of ZSM-5 class catalyst gives the same beneficial results that were once thought obtainable only by adding much larger quantities of ZSM-5 class catalyst.

However, the ZSM-5 type zeolite catalyst, used as an additive catalyst in prior art cracking processes, was injected into the process at such locations that its residence time in the regenerator unit of the process was substantial. This, it is believed, contributed to a rapid aging of the ZSM-5 type zeolite, thereby necessitating frequent additions of substantial amounts of makeup additive catalyst. It is also believed that the circulation of the ZSM-5 type zeolite catalyst through the stripper and the riser mixing zone contributed substantially to the rapid deactivation of the additive catalyst.

It is a primary object of the present invention to decrease the extent of deactivation of the ZSM-5 type zeolite additive catalyst experienced in the prior art cracking processes.

It is an additional object of the present invention to decrease or substantially eliminate the circulation of the ZSM-5 type zeolite catalyst in the riser mixing zone, stripper and regenerator of the cracking reactor.

Other objects of the invention will be apparent to those skilled in the art from the following description of the invention and from appended claims.

SUMMARY OF THE INVENTION

Figure 1:
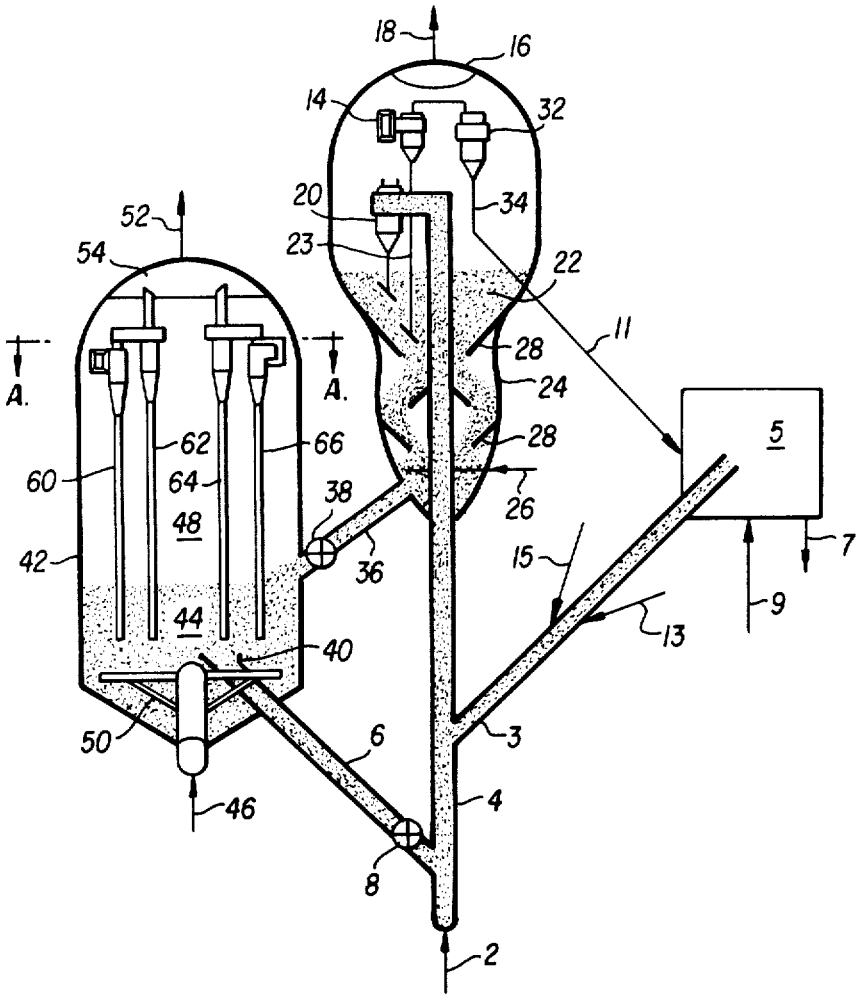
FIG. 1 is a schematic illustration of fluid catalytic (FCC) plant utilizing the present invention.

The ZSM-5 type additive zeolite is introduced into a catalytic cracking riser reactor at a point which is at least 5% of the total riser reactor length downstream from the point of introduction of the hydrocarbonaceous feed into the riser reactor. The additive catalyst, admixed with a conventional cracking catalyst and the feedstock, is then conducted to a conventional downstream reactor separation means wherein a first process stream comprising the ZSM-5 type zeolite and conventional cracking catalyst fines is separated from a second process stream comprised of the remainder of the conventional catalyst. The first process stream is regenerated in a secondary regeneration vessel, separately from the second process stream which is regenerated in a conventional cracking catalyst regenerator.

DETAILED DESCRIPTION OF THE INVENTION

The ZSM-5 type zeolite is introduced into the riser of the catalytic cracking reactor at a point at least 5%, preferably at least 10%, of the total riser reactor length downstream from the point of introduction of the primary hydrocarbonaceous feed stream into the riser reactor. The term total riser reactor length is defined herein as the length extending from the discharge of the primary feed oil nozzle and terminating at the point of exit of the mixture of the catalyst and cracked feed from the riser. The term primary feed oil nozzle is defined herein as the nozzle discharging the primary relatively high volume feedstock stream in the initial point of the riser reactor. Such a primary feed oil nozzle is to be distinguished from a secondary feed oil nozzle, used under some circumstances to discharge the secondary relatively low volume feedstock stream downstream in the riser reactor of the position of the primary feed oil nozzle. The ZSM-5 type zeolite is added to the catalytic cracking process in the amount of 0.1% to 25%, preferably 0.1% to 10%, by weight of the total catalyst inventory.

The ZSM-5 type zeolite is admixed with the fluidized mixture of the conventional cracking catalyst and the hydrocarbon charge, advancing from the upstream riser mixing zone, and is intimately admixed therewith. The fluidized mixture then proceeds into a conventional catalyst-gas separation means in the downstream, upper section of the cracking reactor. Such conventional separation means is well known to those skilled in the art and it comprises, for example, a riser cyclone, followed by a primary and a secondary stage cyclones. In the primary stage cyclone, the conventional cracking catalyst, having a relatively large particle size, is separated from the mixture comprised of cracked hydrocarbons, ZSM-5 type catalyst and fines of the conventional cracking catalyst. The relatively large size (at least 20 micrometers in diameter) conventional cracking catalyst is withdrawn from the dipleg of the primary stage cyclone. In the secondary stage cyclone, gaseous reaction products are separated from the effluent of the primary stage cyclone and withdrawn from the top of the reactor in a conventional manner. The ZSM-5 type zeolite and the fines of the conventional cracking catalyst are recovered from the dipleg of the secondary stage cyclone. The process stream from the dipleg of the secondary stage cyclone (also referred to herein as the first process stream) comprises about 5 to about 80%, preferably about 5 to about 20% by weight of the conventional cracking catalyst fines. The term conventional cracking catalyst fines, as used herein and in the appended claims, designates the fraction of a conventional cracking catalyst which has the size of less than 20 micrometers ($\mu$) in diameter. It may be possible, e.g., by modifying the cyclone design, to achieve a nearly complete separation of the ZSM-5 type zeolite additive catalyst from the conventional cracking catalyst in the second stage cyclone because of the relatively low density and relatively small diameter of the additive catalyst, as discussed in detail below. Such complete separation could be accomplished, for example, by providing the primary cyclone of a relatively low efficiency and the secondary cyclone of relatively high efficiency. However, any carryover of the ZSM-5 catalyst or conventional cracking catalyst fines to the main distillation column bottoms can be recovered and recycled back to the secondary regeneration vessel.

The conventional cracking catalyst is conducted to a conventional regenerator wherein it is regenerated in a conventional manner, e.g., by passing air or other oxygen-containing gas through the bed of catalyst.

The process stream recovered from the dipleg of the secondary stage cyclone is conducted to a separate secondary regenerator means wherein the ZSM-5 type catalyst is at first separated from the fines of the conventional cracking catalyst while both, the fines and the ZSM-5 type catalyst, are regenerated. The ZSM-5 type catalyst is separated from the fines by density difference. The ZSM-5 type catalyst can be made with a packed density of less than 0.6 gram/cm$^3$ (g/cm$^3$), while packed density of the conventional cracking catalyst is greater than 0.9 g/cm$^3$. Thus, the conventional catalyst fines are accumulated in the lower portion of the secondary regenerator vessel, while the ZSM-5 type zeolite catalyst is accumulated in the top portion thereof. Both catalysts are regenerated in a conventional manner, e.g., by passing air or other oxygen-containing gas in the direction countercurrent to the flow of the catalyst through the secondary regeneration means. The segregation of the conventional cracking catalyst fines from the ZSM-5 type additive catalyst can be carried out efficiently only if the regeneration gas (e.g., air) velocity is about 1.0–1.5 times that of the minimum fluidization velocity of the ZSM-5 type additive catalyst. A flue gas is withdrawn at the top of the secondary regeneration vessel. The regenerated ZSM-5 type catalyst is then recycled to the initial point of introduction thereof into the riser reactor. Accordingly, it bypasses the conventional cracking catalyst regenerator vessel and the riser reactor mixing zone, wherein the hydrocarbon feedstock is admixed with the freshly regenerated conventional cracking catalyst. A suitable gaseous medium, e.g., nitrogen, may be used to aid in the injection of the regenerated additive catalyst into the cracking reactor.

If necessary, fresh additive catalyst may be admixed with the regenerated additive catalyst prior to the introduction of the latter into the cracking reactor. Thus, in this embodiment, the combined additive catalyst stream comprises fresh ZSM-5 type makeup and the regenerated ZSM-5 type catalyst with a minimum amount of conventional FCC catalyst fines entrained therein from the secondary regenerator vessel. The combined additive catalyst stream comprises less than 10% by weight of the conventional FCC catalyst fines.

The ZSM-5 type additive catalyst of this invention comprises a class of zeolites characterized by a silica to alumina ratio of at least 12 and a constraint index, defined hereinafter, of about 1 to 12. The additive catalyst used in the invention has a packed density of less than 0.6 g/cm$^3$ and a particle diameter of less than 40 microns ($\mu$m), preferably about 20 to about 40 $\mu$m. The relatively small size of the additive catalyst contributes, it is believed, to its longer time on-stream without substantial deactivation. Without wishing to be bound by any theory of operability, it is believed that larger diameter additive ZSM-5 type zeolite catalyst could be transported with the conventional cracking catalyst to the conventional regenerator where hydrothermal aging of the zeolite catalyst is significant. The large diameter ZSM-5 additive catalyst could also pose severe mass transfer limitation, due to its small pore structure. As is known in the art, the addition of a separate additive catalyst comprising one or more members of the ZSM-5 type zeolites is extremely effective in improving octane and total yield of the catalytic cracking operation. Since the zeolites of the additive catalyst are very active catalytically in the fresh state, only relatively small quantities thereof are necessary to obtain substantial octane improvement in a commercial cracking unit. Thus, the refiner is afforded great flexibility in commercial cracking operations, since the additive catalyst can be quickly introduced, because a small quantity thereof is required as compared to the total inventory of catalyst. The refiner can efficiently control the magnitude of octane increase by controlling the rate of additive catalyst. This type of flexibility could be useful in situations where feed composition or rate changes occur, when demand for high octane gasoline (unleaded) fluctuates, or when capacity for alkylation varies due to mechanical problems or changes in overall refinery operation.

The additive catalyst can be injected at any time during the catalytic cracking process. The additive catalyst can be introduced while the cracking unit is down, or while the cracking unit is on stream. Once the additive catalyst is added to the cracking process, the refiner can return to conventional operation or an operation at lower octane number by eliminating or decreasing the use of additive catalyst. Thus, the increase in octane number over the number obtainable under conventional cracking operations can be controlled by controlling the amount of additive catalyst. However, as set forth above, it is important in accordance with the teachings of this invention to introduce the additive zeolite catalyst into the cracking reactor downstream of the riser mixing zone and remove it from the reactor separately from the conventional cracking catalyst to prevent the passage of the additive catalyst into the conventional catalyst regenerator. It is believed that steaming at high temperatue, e.g., during conventional cracking catalyst regeneration, may cause the collapse of the zeolite crystallite structure, thereby rapidly deactivating the catalyst. Bypassing the conventional cracking catalyst regenerator and stripper of the reactor by the additive catalyst, in accordance with the present invention, eliminates contact thereof with likely steam deactivation locations of the cracking process. In this connection, operating conditions of the secondary regeneration means are less severe than those of conventional cracking catalyst regenerator, thereby minimizing steam production in the secondary regenerator. The secondary regenerator is operated at less severe conditions compared with the conventional regenerator, due to a smaller size regenerator required. The secondary regenerator operation may not be dictated by the overall heat balance of the unit. Consequently, better control schemes can be implemented, e.g., a heat exchange means could be provided in the secondary regenerator to maintain the temperature therein within desired limits. The secondary regenerator is operated at 1200° F. or less, and water partial pressure therein is maintained at 3 pounds per square inch (psi) or less. In contrast, the conventional catalyst regenerator is operated at about 1250° F. or higher temperature, and the water partial pressure therein is about 3 psi or higher. It is believed that the lower temperature and water partial pressure of the secondary regenerator operation promotes lower deactivation rate of the ZSM-5 type additive catalyst.

Another possible mechanism of the reduced site utilization of the additive zeolite catalyst by using conventional injection schemes is a possibility of the increased pore plugging of the additive catalyst by adsorbing heavy hydrocarbon molecules near the catalyst/oil mixing zone in the initial, bottom portion of the riser. Secondary injection of the additive catalyst downstream of the mixing zone, in accordance with this invention, prevents the contact of the additive catalyst with such heavy hydrocarbon molecules.

Catalytic cracking units which can be used in the process of this invention operate within the temperature range of about 400° F. to about 1300° F. and under reduced atmospheric or superatmospheric pressure. The catalytic cracking process may be operated batchwise or continuously. The catalytic cracking process can be either fixed bed, moving bed or fluidized bed and the hydrocarbon chargestock flow may be either concurrent or countercurrent to the conventional catalyst flow. The process of this invention is particularly applicable to the fluid catalytic cracking (FCC) process.

The conventional cracking catalyst used in the process of the invention is any suitable cracking catalyst, e.g., an amorphous catalyst, a crystalline aluminosilicate catalyst, a faujasite catalyst or any mixture thereof.

Hydrocarbon charge stocks undergoing cracking in accordance with this invention comprise hydrocarbons generally and, in particular, petroleum fractions having an initial boiling point range of at least 400° F., a 50% point range of at least 500° F. and an end point range of at least 600° F. Such hydrocarbon fractions include gas oils, residual oils, cycle stocks, whole top crudes and heavy hydrocarbon fractions derived by the destructive hydrogenation of coal, tar, pitches, asphalts and the like. As will be recognized, the distillation of higher boiling petroleum fractions above about 750° F. must be carried out under vacuum in order to avoid thermal cracking. The boiling temperatures utilized herein are expressed, for convenience, in terms of the boiling point corrected to atmospheric pressure.

The members of the class of zeolites of the ZSM-5 type additive catalyst of this invention are characterized by a pore dimension greater than about 5 Angstroms, i.e., they are capable of sorbing paraffins having a single methyl branch as well as normal paraffins, and they have a silica to alumina mole ratio of at least 12. Zeolite A, for example, with a silica to alumina ratio of 2.0, is not useful in this invention, and moreover it has no pore dimension greater than about 5 Angstroms.

The members of the class of zeolites of the additive catalyst constitute an unusual class of natural and synthetic minerals. They are characterized by having a rigid crystalline framework structure composed of an assembly of silicon and aluminum atoms, each surrounded by a tetrahedron of shared oxygen atoms, and a precisely defined pore structure. Exchangeable cations are present in the pores.

The additive catalysts are members of a class of zeolites exhibiting some unusual properties. These zeolites induce profound transformations of aliphatic hydrocarbons to aromatic hydrocarbons in commercially desirable yields and are generally highly effective in alkylation, isomerization, disproportionation and other reactions involving aromatic hydrocarbons. Although they have unusually low alumina contents, i.e., high silica to alumina mole ratios, they are very active even with silica to alumina mole ratios exceeding 30. This activity is surprising, since catalytic activity of zeolites is generally attributed to framework aluminum atoms and cations associated with these aluminum atoms. These zeolites retain their crystallinity for long periods in spite of the presence of steam even at such high temperatures which induce irreversible collapse of the crystal framework of other zeolites, e.g., of the X and A type. Furthermore, carbonaceous deposits, when formed, may be removed by burning at higher than usual temperatures to restore activity. In many environments, the zeolites of this class exhibit very low coke forming capability, conductive to very long times on stream between burning regenerations.

An important characteristic of the crystal structure of this class of zeolites is that it provides constrained access to, and egress from, the intracrystalline free space by virtue of having a pore dimension greater than about 5 Angstroms and pore windows of about a size such as would be provided by 10-membered rings of oxygen atoms. It is to be understood, of course, that these rings are formed by the regular disposition of the tetrahedra making up the anionic framework of the crystalline zeolite, the oxygen atoms themselves being bonded to the silicon or aluminum atoms at the centers of the tetrahedra. Briefly, the preferred zeolites useful as the additive catalysts of this invention possess, in combination: a Constraint Index, as hereinafter defined, of about 1 to 12, a silica to alumina mole ratio of at least about 12, and a structure providing constrained access to the intracrystalline free space.

The silica to alumina mole ratio referred to above may be determined by conventional analysis. This ratio is meant to represent, as closely as possible, the ratio in the rigid anionic framework of the zeolite crystal and to exclude aluminum in the binder or in cationic or other form within the channels.

Although additive catalysts comprising zeolites with a silica to alumina mole ratio of at least about 12 are useful, it is preferred to use zeolites having higher ratios of at least about 30. In some zeolites, the upper limit of silica to alumina mole ratio is unbounded, with values of 30,000 and greater, extending at least theoretically up to infinity. Therefore, the silica to alumina mole ratio of the zeolite component of the additive catalyst for use herein may be from about 12 to infinity, preferably from about 30 to infinity. Such zeolites, after activation, acquire an intracrystalline sorption capacity for normal hexane which is greater than that for water, i.e., they exhibit "hydrophobic" properties. It is believed that this hydrophobic character is advantageous in the present invention.

The zeolites comprising the additive catalysts in this invention freely sorb normal hexane and have a pore dimension greater than about 5 Angstroms. In addition, their structure must provide constrained access to some larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is substantially excluded and the zeolite is not of the desired type. Additive catalysts with zeolites with windows of 10-member rings are preferred, although excessive puckering or pore blockage may render these zeolites substantially ineffective.

Additive catalysts comprising zeolites with windows of 12-membered rings do not generally appear to offer sufficient constraint to produce the advantageous conversions desired in the instant invention, although structures can be conceived, due to pore blockage or other cause, that may be operative.

Rather than attempt to judge from crystal structure whether or not a zeolite possesses the necessary constraint access, a simple determination of the "Constraint Index" may be made by continuously passing a mixture of equal weight of normal hexane and 3-methylpentane over a small sample, approximately 1 gram or less, of zeolite at atmospheric pressure according to the following procedure. A sample of the zeolite, in the form of pellets or extrudates, is crushed to a particle size about that of coarse sand and mounted in a glass tube. Prior to testing, the zeolite is treated with a stream of air at 1000° F. for at least 15 minutes. The zeolite is then flushed with helium and the temperature adjusted between 550° F. and 950° F. to give an overall conversion between 10% and 60%. The mixture of hydrocarbons is passed at 1 liquid hourly space velocity (i.e., 1 volume of liquid hydrocarbon per volume of catalyst per hour) over the zeolite with a helium dilution to give a helium to total hydrocarbon mole ratio of 4:1. After 20 minutes on stream, a sample of the effluent is taken and analyzed, most conveniently by gas chromatography, to determine the fraction remaining unchanged for each of the two hydrocarbons.

The "Constraint Index" is calculated as follows:

$$\text{Constraint Index} = \frac{\log_{10}(\text{fraction of n-hexane remaining})}{\log_{10}(\text{fraction of 3-methylpentane remaining})}$$

The constraint index approximates the ratio of the cracking rate constants for the two hydrocarbons. Zeolites suitable for the present invention are those having a constraint index from 1.0 to 12.0. Constraint Index (C.I.) values for some typical zeolites, including some not within the scope of this invention, are:

| Zeolite | C.I. |
|---|---|
| Erionite | 38 |
| ZSM-5 | 8.3 |
| ZSM-11 | 8.7 |
| ZSM-35 | 6.0 |
| TMA Offretite | 3.7 |
| ZSM-38 | 2.0 |
| ZSM-12 | 2 |
| Beta | 0.6 |
| ZSM-4 | 0.5 |
| Acid Mordenite | 0.5 |
| REY | 0.4 |
| Amorphous Silica-Alumina | 0.6 |
| ZSM-23 | 9.1 |

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby have different constraint indices. Constraint Index seems to vary somewhat with the severity of operation (conversion). Therefore, it will be appreciated that it may be possible to so select test conditions to establish multiple constraint indices for a particular given zeolite which may be both inside and outside the above-defined range of 1 to 12.

Thus, it should be understood that the parameter and property "Constraint Index" as such value is used herein is an inclusive rather than an exclusive value. That is, a zeolite when tested by any combination of conditions within the testing definition set forth herein-above to have a constraint index of 1 to 12 is intended to be included in the instant catalyst definition even though the same identical zeolite tested under other defined conditions may give a constraint index value outside of 1 to 12.

The members of the class of zeolites defined herein which may be used as the additive catalyst are exemplified by ZSM-5, ZSM-11, ZSM-12, ZSM-23, ZSM-35, ZSM-38 and other similar materials. U.S. Pat. No. 3,702,886 describing and claiming ZSM-5 is incorporated herein by reference. U.S. Pat. No. Re. 29,948 describing and claiming a crystalline material with an X-ray diffraction pattern of ZSM-5, is incorporated herein by reference as is U.S. Pat. No. 4,061,724 describing a high silica ZSM-5 referred to as "silicalite" in such patent.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

ZSM-38 is more particularly described in U.S. Pat. No. 4,046,859, the entire contents of which are incorporated herein by reference.

Natural zeolites may sometimes be converted to this class of zeolites by various activation procedures and other treatments, such as base exchange, steaming, alumina extraction and calcination, alone or in combinations. Natural minerals which may be so treated include ferrierite, brewsterite, stilbite, dachiardite, epistilbite, heulandite and clinoptilolite. The preferred zeolites of the additive catalyst are ZSM-5, ZSM-11, ZSM-12, ZSM-23, ZSM-35 and ZSM-38, with ZSM-5 being particularly preferred.

The zeolites used as additive catalysts in this invention may be in the hydrogen form or they may be base exchanged or impregnated to contain a rare earth cation complement. Such rare earth cations comprise Sm, Nd, Pr, Ce and La. It is desirable to calcine the zeolite after base exchange.

In a preferred aspect of this invention, the zeolites comprising the additive catalysts are selected as those having a crystal framework density, in the dry hydrogen form, of not substantially below about 1.6 grams per cubic centimeter. It has been found that zeolites which satisfy all three of these criteria are most desired. Therefore, the preferred additive catalysts of this invention are those comprising a zeolite having a constraint index as defined above of about 1 to 12, a silica to alumina mole ratio of at least about 12 and a dried crystal density of not substantially less than about 1.6 grams per cubic centimeter. The dry density for known structures may be calculated from the number of silicon plus aluminum atoms per 1000 cubic Angstroms, as given, e.g., on page 19 of the article on *Zeolite Structure* by W. M. Meier. This paper is included in *Proceedings of the Conference on Molecular Sieves,* London, April 1967, published by the Society of Chemical Industry, London, 1968. When the crystal structure is unknown, the crystal framework density may be determined by classical pycnometer techniques. For example, it may be determined by immersing the dry hydrogen form of the zeolite in an organic solvent which is not sorbed by the crystal. It is possible that the unusual sustained activity and stability of this class of zeolites are associated with its high crystal anionic framework density of not less than about 1.6 grams per cubic centimeter. This high density, of course, must be associated with a relatively small amount of free space within the crystal, which might be expected to result in more stable structures. This free space, however, seems to be important as the locus of catalytic activity.

Crystal framework densities of some typical zeolites, including some which are not within the purview of this invention, are:

| Zeolite | Void Volume (cc/cc) | Framework Density (g/cc) |
|---|---|---|
| Ferrierite | 0.28 | 1.76 |
| Mordenite | 0.28 | 1.7 |
| Z5M-5, -11 | 0.29 | 1.79 |
| ZSM-12 | — | 1.8 |
| ZSM-23 | — | 2.0 |
| Dachiardite | 0.32 | 1.72 |
| L | 0.32 | 1.61 |
| Clinoptilolite | 0.34 | 1.71 |
| Laumontite | 0.34 | 1.77 |
| ZSM-4 (Omega) | 0.38 | 1.65 |
| Heulandite | 0.39 | 1.69 |
| P | 0.41 | 1.57 |
| Offretite | 0.40 | 1.55 |
| Levynite | 0.40 | 1.54 |
| Erionite | 0.35 | 1.51 |
| Gmelinite | 0.44 | 1.46 |
| Chabazite | 0.47 | 1.45 |
| A | 0.5 | 1.3 |
| Y | 0.48 | 1.27 |

The additive catalysts of this invention may be prepared in various ways. The additive catalyst may be separately prepared in the form of particles, such as pellets or extrudates, for example, and simply mixed in the required proportions. The particle size of the individual component particles may be quite small, for example less than 40 microns in diameter, preferably about 20 to about 40 microns in diameter, when intended for use in fluid bed operation, or they may be as large as up to about 4 milimeter (mm) for fixed bed (or moving bed) operation. The components may also be mixed as powders and formed into pellets or extrudates, each pellet containing both components in substantially the required proportions.

As is the case with many catalysts, it is desirable to incorporate the zeolite component of the additive catalyst in a matrix. Such matrix is useful as a binder and imparts greater resistance to the catalyst for the severe temperature, pressure and velocity conditions encountered in many cracking processes.

Matrix materials include both synthetic and natural substances. Such substances include clays, silica and/or metal oxides. The latter may be either naturally occurring or in the form of gelatinous precipitates, sols or gels including mixtures of silica and metal oxides. Frequently, zeolite materials have been incorporated into naturally occurring clays, e.g. bentonite and kaolin.

In addition to the foregoing materials, the zeolite used in the invention can be composited with a porous matrix material, such as silica-alumina, silica-magnesia, silica-zirconia, silica-thoria, silica-beryllia, silica-titania, as well as ternary compositions, such as silica-alumina-thoria, silica-alumina-zirconia, silica-alumina-magnesia and silica-magnesia-zirconia. The matrix can be in the form of a cogel. A mixture of clay in combination with silica or any of the above specified cogels to form a matrix is highly preferred.

Conventional cracking catalysts contain active components which may be zeolitic or non-zeolitic. The non-zeolitic active components are generally amorphous silica-alumina and crystalline silica-alumina. However, the major conventional cracking catalysts presently in use generally comprise a crystalline zeolite (active component) in a suitable matrix. Representative crystalline zeolite active component constituents of conventional cracking catalysts include zeolite A (U.S. Pat. No. 2,882,243), zeolite X (U.S. Pat. No. 2,882,244), zeolite Y (U.S. Pat. No. 3,130,007), zeolite ZK-5 (U.S. Pat. No. 3,247,195), zeolite ZK-4 (U.S. Pat. No. 3,314,752), synthetic mordenite and dealuminized synthetic mordenite, as well as naturally occurring zeolites, including chabazite, faujasite, mordenite, and the like. Preferred crystalline zeolites include the synthetic faujasite zeolites X and Y, with particular preference being accorded zeolite Y.

The additive crystalline zeolite employed as a constituent in the cracking catalyst compositions of the present invention is essentially characterized by a high catalytic activity.

In general, the crystalline zeolites are ordinarily ion exchanged either separately or in the final catalyst with a desired cation to replace alkali metal present in the zeolite as found naturally or as synthetically prepared. The exchange treatment is such as to reduce the alkali metal content of the final catalyst to less than about 1.5 weight percent, and preferably less than about 0.5 weight percent. The purpose of ion exchange is to substantially remove alkali metal cations which are known to be deleterious to cracking, as well as to introduce particularly desired catalytic activity by means of the various cations used in the exchange medium. For the cracking operation described herein, preferred exchanging cations are hydrogen, ammonium, rare earth metals and mixtures thereof, with particular preference being accorded rare earth metals. Ion exchange is suitably accomplished by conventional contact of the zeolite with a suitable salt solution of the desired cation, such as, for example, the sulfate, chloride or nitrate salts.

It is preferred to have the crystalline zeolite of the conventional cracking catalyst in a suitable matrix, since this catalyst form is generally characterized by a high resistance to attrition, high activity and exceptional steam stability. Such catalysts are readily prepared by dispersing the crystalline zeolite in a suitable siliceous sol and gelling the sol by various means. The inorganic oxide which serves as the matrix in which the above crystalline zeolite is distributed includes silica gel or a cogel of silica and a suitable metal oxide. Representative cogels include silica-alumina, silica-magnesia, silica-zirconia, silica-thoria, silica-beryllia, silica-titania, as well as ternary combinations, such as silica-alumina-magnesia, silica-alumina-zirconia and silica-magnesia-zirconia. Preferred cogels include silica-alumina, silica-zirconia or silica-alumina-zirconia. The above gels and cogels will generally comprise a major proportion of silica and a minor proportion of the other aforementioned oxide or oxides, Thus, the silica content of the siliceous gel or cogel matrix will generally fall within the range of 55 to 100 weight percent, preferably 60 to 95 weight percent, and the other metal oxide or oxides content will generally be within the range of 0 to 45 weight percent, and preferably 5 to 40 weight percent. In addition to the above, the matrix may also comprise natural or synthetic clays, such as kaolin type clays, montmorillonite, bentonite or halloysite. These clays may be used either alone or in combination with silica or any of the above specified cogels in a matrix formulation.

Where a matrix is used, content of catalytically active component of a conventional cracking catalyst, e.g., crystalline zeolite, i.e., the amount of the zeolite Y component, in the conventional cracking catalyst, is generally at least about 5 weight percent, and more particularly between about 5 and about 50 weight percent. Ion exchange of the zeolite to replace its initial alkali metal content can be accomplished either prior to or subsequent to incorporation of the zeolite into the matrix.

Where no matrix as such is used, such as where a non-zeolitic cracking catalyst, e.g. silica-alumina, is used, content of catalytically active component will, of course, approach 100 weight percent. Also, since silica-alumina may serve as a matrix material for catalytically active zeolite component, 100 weight percent catalytically active catalyst may exist.

The above compositions may be readily processed so as to provide fluid cracking catalysts by spray drying the composite to form microspheroidal particles of suitable size. Alternatively, the composition may be adjusted to suitable concentration and temperature to form bead type catalyst particles suitable for use in moving bed type cracking systems. The catalyst may also be used in various other forms, such as those obtained by tabletting, balling or extruding.

Additional details of the invention will now be described in conjunction with one exemplory emobodiment thereof illustrated in FIGS. 1–3.

Referring now to FIG. 1, a hydrocarbon feed 2, such as gas oil boiling from about 600° F. up to 1000° F., is passed after preheating thereof to the bottom portion of riser 4 for admixture with hot regenerated conventional cracking catalyst introduced by standpipe 6 provided with flow control valve 8. A suspension of catalyst in hydrocarbon vapors at a temperature of at least about 950° F. but more usually at least 1000° F. is thus formed in the lower portion of riser 4 for flow upwardly therethrough under hydrocarbon conversion conditions.

The suspension initially formed in the lower portion of the riser proceeds upwardly for admixture with a stream 3 comprising a freshly regenerated and a makeup additive catalyst of ZSM-5 type zeolite. The regenerated additive catalyst is passed into the riser 4 from the secondary regenerator 5, while the fresh makeup catalyst is introduced through a conduit 15. A fluidizing stream, e.g., nitrogen, may optionally be introduced through a conduit 13. The operation of the secondary regenerator means 5 is discussed in detail below. The hydrocarbon vapor-catalyst suspension formed in the riser reactor is passed upwardly through riser 4 under hydrocarbon conversion conditions of at least 900° F., and more usually at least 950° F., before discharge into a riser cyclone 20.

In the riser cyclone, the hydrocarbon vapor-catalyst suspension undergoes a preliminary separation of the catalyst and the cracked hydrocarbons. The cracked hydrocarbons and entrained catalysts are then conducted to a primary cyclone 14 and then to a secondary stage cyclone 32. In the secondary stage cyclone, nearly complete recovery of the ZSM-5 catalyst may be achieved due to its low density and relatively small diameter of the catalyst particles of less than 40 microns. The dipleg 34 of the secondary stage cyclone extends into a secondary regeneration means 5 through a conduit 11 for the regeneration of the ZSM-5 additive catalyst and the segregation of the ZSM-5 catalyst from the FCC fines. A minimum amount of the ZSM-5 additive catalyst and of the conventional cracking catalyst fines may be entrained with the stream of cracked hydrocarbons 18 to the main fractionation column bottom, not shown. Provisions can be made in the fractionation column to recover the entrained ZSM-5 additive catalyst and conventional cracking catalyst fines and transport them back to the secondary regeneration vessel 5, e.g., by providing a hydrocyclone, not shown, outside of the fractionation column to treat the fractionation column bottoms stream. In the secondary regeneration means 5, the ZSM-5 type additive catalyst is separated from the FCC conventional catalyst fines (having average diameter of about less than 20 m). It is also possible to separate the ZSM-5 additive catalyst from the FCC conventional catalyst fines by elutriation. However, the segregation by density difference is preferred for the purposes of this invention since the ZSM-5 type additive catalyst can be made with a packed density of less than about 0.6 g/cm$^3$ compared with a packed density of greater than 0.9 g/cm$^3$ for the FCC conventional catalyst.

Figure 3:
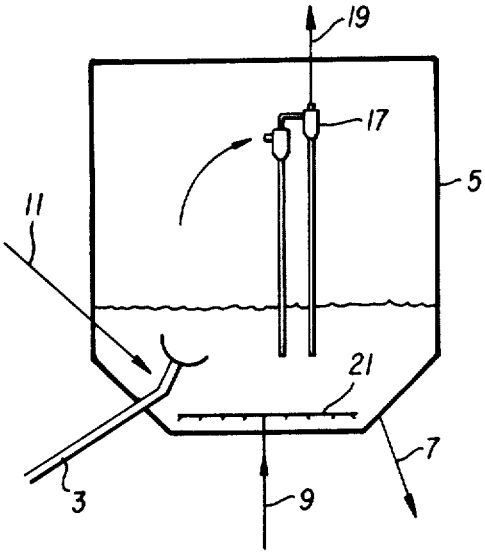
FIG. 3 is a schematic illustration of a secondary regenerization means wherein the additive zeolite of ZSM-5 type is regenerated.

FIG. 3 illustrates the details of the secondary regeneration means wherein the additive catalyst is regenerated and separated from the conventional cracking FCC catalyst. The coked additive catalyst is conducted into the secondary regenerator 5 through a conduit 11 and is regenerated therein by air introduced into the regenerator by a conduit 9. Due to density difference, the conventional cracking catalyst fines accumulate at the bottom of the regenerator and are removed therefrom by a conduit 7 to the storage for future disposal. In contrast, the lighter additive catalyst tends to accumulate in the upper portion of the fluidized regenerator bed and is removed therefrom by a conduit 3 which conducts it to the initial point of introduction of the additive catalyst in the riser 4 (FIG. 1). A conventional dispersion means 21 is used in the regenerator to aid in dispersing the regeneration gas. In the upper portion of the secondary regenerator, a conventional cyclone means 17 is used to separate the entrained catalyst from the flue gas stream. The catalyst is then returned through the dipleg means into the bed of catalyst being regenerated at the bottom of the regenerator, and the flue gas is withdrawn from the generator by a conduit 19.

In the reactor vessel, separated hydrocarbon vapors are passed from the secondary stage cyclone 32 to a plenum chamber 16 for withdrawal therefrom by a conduit 18. The hydrocarbon vapors, together with gasiform material separated by stripping gas, as discussed below, are passed by conduit 18 to a downstream fractionation equipment, not shown. Catalyst separated from hydrocarbon vapors in the cyclonic separation means is passed by diplegs, such as by dipleg 23, to a dense fluid bed of separated catalyst 22 retained about an upper portion of riser conversion zone 4. Catalyst bed 22 is maintained as a downwardly moving fluid bed of catalyst countercurrent to rising gasiform material. The catalyst passes downwardly through a stripping zone 24 immediately therebelow and countercurrently to rising stripping gas introduced to a lower portion thereof by conduit 26. Baffles 28 are provided in the stripping zone to improve the stripping operation.

The catalyst is maintained in the stripping zone 24 for a period of time sufficient to effect a high temperature desorption of feed compounds deposited thereon which are then carried overhead by the stripping gas. The stripping gas with desorbed hydrocarbons passes through one or more primary cyclonic separating means 14 and then through the secondary cyclonic separating means 32, wherein ZSM-5 type catalyst and entrained conventional cracking catalyst fines are separated and returned to the secondary regenerator vessel 5 by dipleg 34 and conduit 11. The hydrocarbon conversion zone comprising riser 4 may terminate in an upper enlarged portion of the catalyst collecting vessel with the commonly known bird cage discharge device or an open end "T" connection may be fastened to the riser discharge which is not directly connected to the cyclonic catalyst separation means. The cyclonic separation means may be spaced apart from the riser discharge so that an initial catalyst separation is effected by a change in velocity and direction of the discharged suspension so that vapors less encumbered with catalyst fines may then pass through one or more cyclonic separation means before passing to a product separation step. In any of these arrangements, gasiform materials comprising stripping gas hydrocarbon vapors and desorbed sulfur compounds are passed from the cyclonic separation means represented by separator 32 to a plenum chamber 16 for removal with hydrocarbon products of the cracking operation by conduit 18. Gasiform material comprising hydrocarbon vapors is passed by conduit 18 to a product fractionation step, not shown. Hot stripped conventional cracking catalyst at an elevated temperature is withdrawn from a lower portion of the stripping zone by conduit 36 for transfer to a fluid bed of catalyst being regenerated in a conventional cracking catalyst regeneration zone. Flow control valve 38 is provided in coked catalyst conduit 36.

This type of catalyst regeneration operation is referred to as a swirl type of catalyst regeneration due to the fact that the catalyst bed tends to rotate or circumferentially circulate about the vessel's vertical axis and this motion is promoted by the tangential spent catalyst inlet to the circulating catalyst bed. Thus, the tangentially introduced catalyst at an elevated temperature is further mixed with hot regenerated catalyst or catalyst undergoing regeneration at an elevated temperature and is caused to move in a circular or swirl pattern about the regenerator's vertical axis as it also moves generally downward to a catalyst withdrawal funnel 40 (sometimes called the "bathtub") adjacent the regeneration gas distributor grid. In this catalyst regeneration environment, it has been found that the regeneration gases comprising flue gas products of carbonaceus material combustion tend to move generally vertically upwardly through the generally horizontally moving circulating catalyst to cyclone separators positioned above the bed of catalyst in any given vertical segment.

Figure 2:
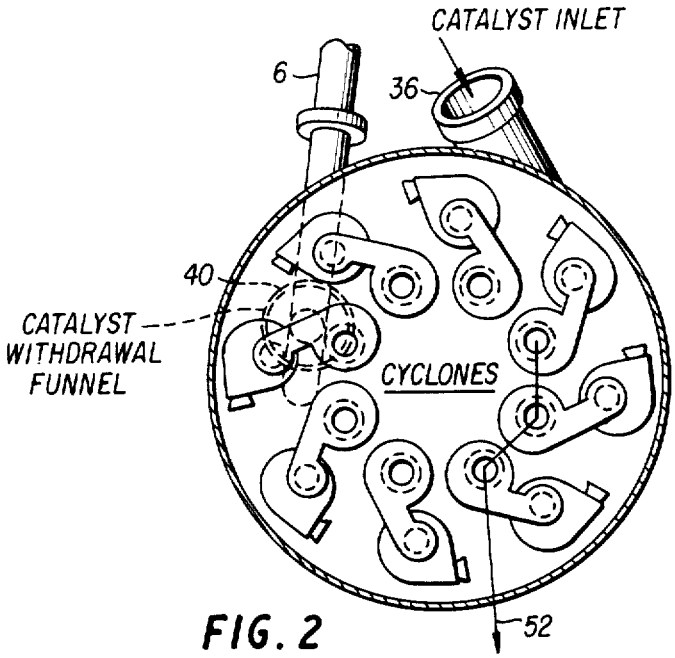
FIG. 2 is a section view, taken along plane A—A, of the regenerator of the plant of FIG. 1.

As shown in FIG. 2, the catalyst tangentially introduced to the regenerator by conduit 36 causes the catalyst to circulate in a clockwise direction in this specific embodiment. As the bed of catalyst continues its circular motion, some catalyst particles move from an upper portion of the mass of catalyst particles suspended in regeneration gas downwardly therethrough to a catalyst withdrawal funnel 40 in a segment of the vessel adjacent to the catalyst inlet segment. In the regeneration zone 42, housing a mass of the circulating suspended catalyst particles 44 in upflowing oxygen-containing regeneration gas introduced to the lower portion thereof by conduit distributor means 46, the density of the mass of suspended catalyst particles may be varied by the volume of regeneration gas used in any given segment or segments of the distributor grid. Generally speaking, the circulating suspended mass of catalyst particles 44 undergoing regeneration with oxygen containing gas to remove carbonaceous deposits by burning will be retained as a suspended mass of swirling catalyst particles varying in density in the direction of catalyst flow and a much less dense phase of suspended catalyst particles 48 will exist thereabove to an upper portion of the regeneration zone. Under carefully selected relatively low regeneration gas velocity conditions, a rather distinct line of demarcation may be made to exist between a dense fluid bed of suspended catalyst particles and a more dispersed suspended phase (dilute phase) of catalyst thereabove. However, as the regeneration gas velocity conditions are increased, there is less of a demarcation line and the suspended catalyst passes through regions of catalyst particle density generally less than about 30 lbs. per cu. ft. (lbs/ft$^3$). A lower catalyst bed density of at least 20 lbs/ft$^3$ is preferred.

A segmented regeneration gas distributor grid 50 positioned in the lower cross-sectional area of the regeneration vessel 42 is provided as shown in FIG. 1 and is adapted to control the flow of regeneration gas passed to any given vertical segment of the catalyst bed thereabove. In this arrangement, it has been found that even with the generally horizontally circulating mass of catalyst, the flow of regeneration gas is generally vertically upwardly through the mass of catalyst particles so that regeneration gas introduced to the catalyst bed by any given grid segment or portion thereof may be controlled by grid openings made available and the air flow rate thereto. Thus, oxygen containing combustion gases after contact with catalyst in the regeneration zone are separated from entrained catalyst particles by the cyclonic means provided and vertically spaced thereabove. The cyclone combinations diagrammatically represented in FIG. 1 are intended to correspond to that represented in FIG. 2. Catalyst particles separated from the flue gases passing through the cyclones are returned to the mass of catalyst therebelow by the plurality of provided cyclone diplegs.

As mentioned above, regenerated conventional cracking catalyst withdrawn by funnel 40 is conveyed by standpipe 6 to the hydrocarbon conversion riser 4.

It will be clear from FIG. 1 that the term "circulating inventory of catalyst" referred to herein includes the conventional cracking catalyst and the additive catalyst of ZSM-5 type, i.e., the catalyst mass in riser 4, in the dense bed 22, in the dense bed in stripper 24, in the dense bed in the regenerator 44, in the secondary regenerator vessel 5, in conduits 3 and 11, as well as the catalyst material in conduits 36 and 6 and the catalyst material suspended in dilute phase and cyclones in the reactor section and the regenerator section. This circulating inventory has the temperature substantially above about 600° F., since the regenerator 42 operates at a temperature higher than about 1000° F., usually in the range of about 1050° F. to about 1300° F., and the reactor at a temperature higher than 800° F.

In actual operation, because the catalytic activity of the conventionl cracking catalyst tends to decrease with age, fresh makeup conventional cracking catalyst, usually amounting to about 1 or 2% of the circulating inventory per day, is added to maintain optimal catalyst activity, in the manner similar to that in which the additive makeup catalyst is added through the conduit 15. This catalyst makeup is usually added via a hopper (fresh catalyst storage hopper) and conduit (not shown) into the regenerator.

A recent advance in the art of catalytic cracking is disclosed in U.S. Pat. No. 4,072,600, the entire contents of which are incorporated herein by reference. One embodiment of this patent teaches that trace amounts of a metal selected from the group consisting of platinum, palladium, iridium, osmium, rhodium, ruthenium, and rhenium, when added to cracking catalysts, enhance significantly conversion of carbon monoxide during the catalyst regeneration operation.

In employing this recent advance in the present invention, the amount of said metal added to the conventional cracking catalyst can vary from between about 0.01 ppm to about 100 ppm based on total circulating catalyst inventory. The aforesaid metals can also be introduced into the process via the additive catalyst in amounts between about 1.0 ppm and about 1000 ppm based on total additive catalyst.

After cracking, the resulting product gas is compressed and the resulting products may suitably be separated from the remaining components by conventional means, such as adsorption, distillation, etc.

It will be apparent to those skilled in the art that although the embodiments of FIGS. 1–3 were described above in conjunction with a swirl type conventional cracking catalyst regenerator, the process of the invention can be carried out with any conventional regeneration means used to regenerate a conventional cracking catalyst.

It will be apparent to those skilled in the art that the specific embodiments discussed above can be successfully repeated with ingredients equivalent to those generically or specifically set forth above and under variable process conditions. From the foregoing specification, one skilled in the art can readily ascertain the essential features of this invention and without departing from the spirit and scope thereof can adapt it to various diverse applications.

I claim:

1. In a catalytic cracking process comprising cracking a hydrocarbonaceous feed in a riser reactor in the presence of a catalyst comprised of a mixture of a conventional cracking catalyst and a ZSM-5 type zeolite additive catalyst serving to increase octane number and overall yield of said process, the improvement whereby deactivation of said addition catalyst is minimized which comprises introducing the ZSM-5 type zeolite additive catalyst having a particle size of about 20 to 40 microns at a point which is at least 5% of the total riser reactor length downstream from the point of introduction of the hydrocarbonaceous feed, wherein the resulting mixture of the hydrocarbonaceous feed and catalyst proceeds through the riser reactor to a downstream reactor separation means wherein a first process stream comprising the ZSM-5 type catalyst and conventional cracking catalyst fines is separated from a second process stream comprising the conventional cracking catalyst; and wherein said second process stream is conducted to a first regenerator vessel operating at a temperature of at least about 1250° F. wherein the conventional cracking catalyst is regenerated by an oxygen-containing gas, and said first process stream is conducted to a second regenerator vessel operating at a temperature no greater than about 1200° F.

2. A process of claim 1 wherein the ZSM-5 type catalyst is introduced at a point which is at least 10% of the total riser reactor length downstream from the point of introduction of the hydrocarbonaceous feed.

3. A process of claim 1 wherein the first process stream comprises about 5% to about 80% by weight of the conventional cracking catalyst fines.

4. A process of claim 3 wherein the first process stream is conducted to a second regenerator vessel means, physically separate and distinct from the first regenerator vessel means, and placed physically outside of the riser reactor.

5. A process of claim 4 wherein the conventional cracking catalyst fines are separated from the ZSM-5 type catalyst in the second regenerator vessel means.

6. A process of claim 5 wherein the separation of the conventional cracking catalyst from the ZSM-5 type catalyst is accomplished in said second regenerator vessel means by means of the density difference between the conventional cracking catalyst and the ZSM-5 type catalyst.

7. A process of claim 6 wherein the first process stream is regenerated in the second regenerator means by an oxygen-containing gas.

8. A process of claim 7 wherein the regenerated ZSM-5 type catalyst is conducted from the second regenerator vessel means to the riser reactor.

9. A process of claim 8 wherein the regenerated conventional cracking catalyst is conducted from the first regenerator vessel means to the riser reactor.

10. A process of claim 9 wherein a fresh make-up ZSM-5 type catalyst is admixed with the regenerated ZSM-5 type catalyst prior to the introduction thereof into the riser reactor.

11. A process of claim 1 wherein said hydrocarbonaceous feed is introduced to said riser reactor through a primary feed oil nozzle discharging a primary hydrocarbonaceous feed at an initial upstream point in the riser reactor and a secondary feed oil nozzle discharging lower volumes, relative to said primary feed nozzle, of a secondary hydrocarbonaceous feed downstream of said primary feed nozzle, said ZSM-5 type zeolite additive catalyst being introduced to the riser reactor at a point which is at least 5% of the total riser reactor length downstream from said primary feed oil nozzle.

* * * * *

UNITED STATES PATENT AND TRADEMARK OFFICE

CERTIFICATE OF CORRECTION

PATENT NO. : 4,490,241

DATED : December 25, 1984

INVENTOR(S) : Tai-Sheng Chou

It is certified that error appears in the above-identified patent and that said Letters Patent is hereby corrected as shown below:

Col. 7, line 9, "conductive" should be --conducive--.

Col. 11, line 65, replace the comma after the word "oxides" with a period.

Col. 16, line 52, "addition" should be --additive--.

Signed and Sealed this

*Second* Day of *July 1985*

[SEAL]

*Attest:*

DONALD J. QUIGG

*Attesting Officer*

*Acting Commissioner of Patents and Trademarks*